US005181327A

United States Patent [19]

Powell

[11] Patent Number: 5,181,327

[45] Date of Patent: Jan. 26, 1993

[54] LOADWIDTH GAUGE FOR RAILWAY CARS

[75] Inventor: Charles S. Powell, Roanoke, Va.

[73] Assignee: Norfolk Southern Railway Co., Norfolk, Va.

[21] Appl. No.: 861,098

[22] Filed: Mar. 31, 1992

[51] Int. Cl.[5] ..... G01B 5/14

[52] U.S. Cl. ..... 33/833; 33/651

[58] Field of Search ..... 33/833, 832, 501.45, 33/501.09, 501.08, 501, 501.11, 651, 651.1

[56] References Cited

U.S. PATENT DOCUMENTS 1,667,684 4/1928 Trimble ..... 33/651

1,784,160 12/1930 Remoud ..... 33/651

*Primary Examiner*—William A. Cuchlinski, Jr.

*Assistant Examiner*—William C. Dowling

*Attorney, Agent, or Firm*—Watson, Cole, Grindle & Watson

[57] ABSTRACT

A gauge for determining the maximum width of a load of material supported on a railway car has an elongated, upstanding boom and car side sill engaging feet extending transversely of one side of the boom. A gauge support is mounted on the opposite side of the boom to facilitate sliding the gauge along a side sill so as to gauge any extent of the material beyond a predetermined fixed distance at which the terminal end of the feet are set from the boom to thereby determine the maximum width of the load of material on the car.

4 Claims, 1 Drawing Sheet

21
19
23
22
3
3
34
35
33
29
26
28
24
27
28
26
27
27
28
31
32
25
y 21
35
19
29
L
14
15
L
18
17
16
24
10
y
11
12
13
x 23
22

LOADWIDTH GAUGE FOR RAILWAY CARS

BACKGROUND OF THE INVENTION

This invention relates generally to a gauge for determining the maximum width of especially pulpwood loaded on a railway vehicle. More particularly, the gauge is a hand-held device having an upstanding elongated boom with transversely extending feet for slidingly bearing against the side sills of the railway vehicle. A terminal end of the feet are spaced a predetermined fixed distance from the boom such that any over-extent of the pulpwood beyond such distance from each of the side sills is gauged as the gauge is slid along each of the sills to thereby determine the maximum width of the load on the car.

Pulpwood railway cars are typically loaded with pulpwood from opposite sides of the car for transport to a papermaking mill to be ground into pulp. The pulpwood car is similar to a flatbed car except that the pulpwood supporting surface of the car slopes inwardly and downwardly from opposite sides of the car toward a centerline crease extending longitudinally of the car. The logs are cut to length for stacking from opposite sides of the car and typically extend beyond the car side sills.

The interchange rules of the American Association of Railroads prescribe a maximum width of load for pulpwood cars not to exceed 5½ feet from the centerline of the car for an 11 foot maximum width of the load.

Presently, the maximum loadwidth is arbitrarily and inexactly determined by the workman by visual inspection or by using a tape measure or the like to determine the maximum overhang of the logs extending beyond the side sills of the car so as to approximate the 5½ foot limit from the car centerline. When a log or logs are found to exceed this limit, they are either "bumped up" by inwardly shifting the log, or the log or logs are sawed off to maintain the prescribed loadwidth.

SUMMARY OF THE INVENTION

It is therefore an object of the present invention to provide a gauge which is easy to use and store, is lightweight, economical to produce, yet is highly effective in determining the maximum width of the load.

The present gauge comprises a hand-held device having an upstanding elongated boom with feet extending transversely from one side of the boom for slidingly engaging each side sill of the car. The terminal end of the feet are spaced a predetermined fixed distance from the boom which, depending on the car width, measures an overhang distance of the pulpwood extent equalling approximately 5½ feet from the centerline of the car. Handle grips or the like are mounted and extend outwardly from an opposite side of the boom permitting the operator to slide the device along each side sill of the car to assure a maximum overhang of the logs as determined by the boom for logs from the lowermost to the topmost of the stack.

The present device need not be mounted on the ground or on the rails for measuring loadwidth, and avoids the need for a level bubble or the like. The boom remains parallel to the adjacent side sill of the car since the transversely extending feet are perpendicular to the boom thereby permitting loadwidth gauging to be carried out on cars supported on banked rails. The feet are vertically spaced apart to assure parallelism between the boom and the adjacent side sill.

Other objects, advantages and novel features of the invention will become more apparent from the following detailed description of the invention when taken in conjuction with the accompanying drawings.

DETAILED DESCRIPTION OF THE INVENTION

Figure 1:
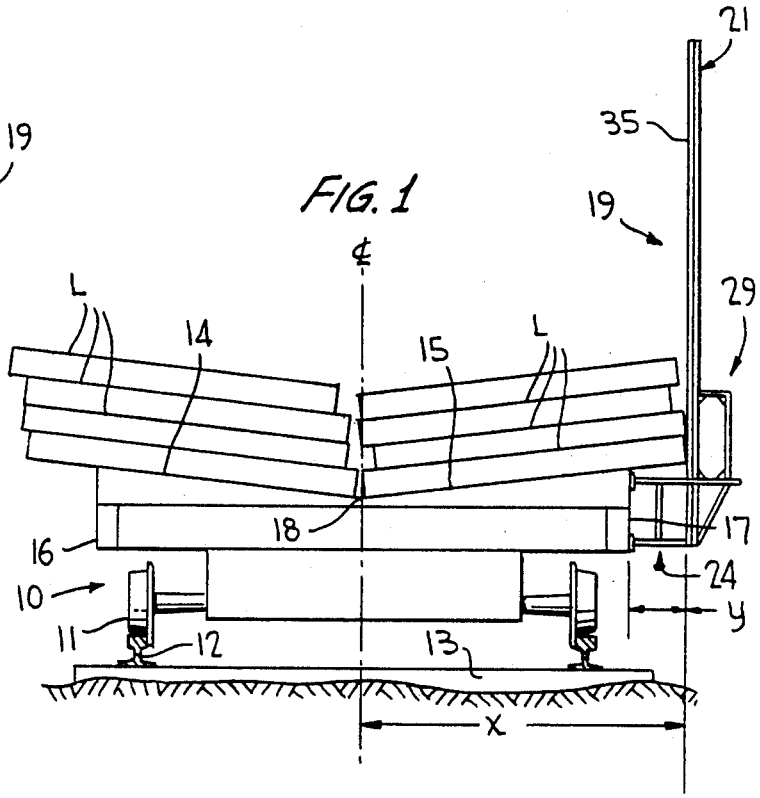
FIG. 1 is an end view of a pulpwood railway car partially loaded with pulpwood and showing the position of use of the gauge according to the invention.
Figure 3:
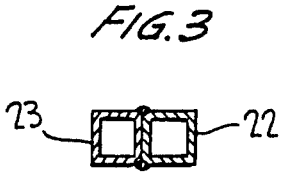
FIG. 3 is a cross-sectional view taken substantially along the line 3—3 of FIG. 2.

Turning now to the drawing wherein like reference characters refer to like and corresponding parts throughout the several views, a pulpwood railway car 10 is shown in FIG. 1 with its rail wheels 11 in rolling engagement with rails 12 mounted on railroad cross-ties 13.

The upper supporting surface of the car slopes downwardly and inwardly as at 14 and 15 respectively from side sills 16 and 17 of the car toward the car centerline forming a longitudinal crease 18 along that centerline. Pulpwood logs L are typically loaded onto sloping surfaces 14 and 15 from opposite sides of the car and are stacked to some desired height. As shown, inner ends of the stacked logs oftentimes extend beyond the car centerline or short thereof in the process of stacking such that the overhang distance y of the logs beyond each of the car side sills exceeds the permissible distance x, which includes the overhang distance y, of 5½ feet from the car centerline as Prescribed by the interchange rules of the AAR regulations for pulpwood cars. Otherwise, the length of logs L are such as to exceed overhang distance y resulting in a load overwidth exceeding the premissible 11 foot width.

Figure 2:
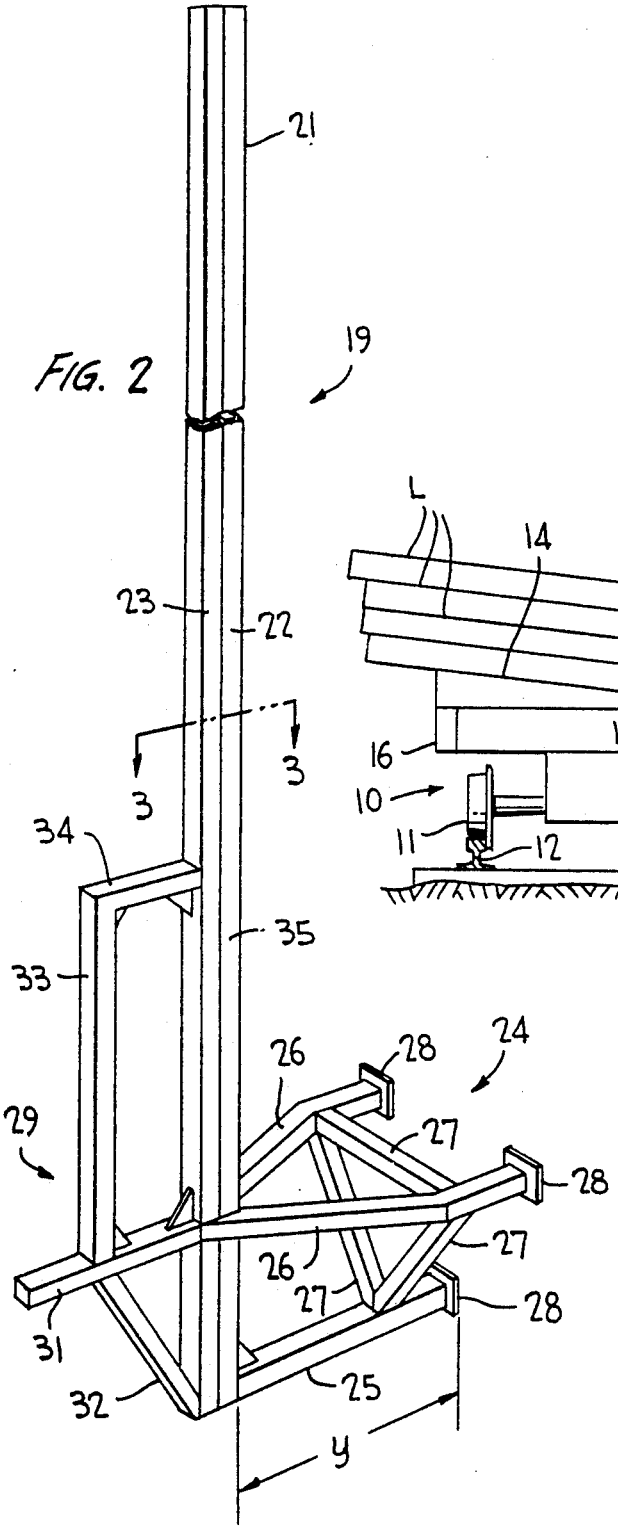
FIG. 2 is an upright Perspective view, at an enlarged scale, of the gauge according to the invention.

Gauge 19 of the invention is shown in its position of use in FIG. 1 and is shown in detail at an enlarged scale in FIG. 2.

The gauge comprises a hand-held device having an elongated, upstanding boom 21 which may comprise a Pair of hollow aluminum tubes 22, 23 of square cross-section welded or otherwise interconnected together.

Feet 24 are mounted on the boom at or near the lower end thereof and extend transversely from one side of the boom. The feet may comprise a lower strut 25 and a pair of upper struts 26 welded or otherwise connected to the boom with connecting braces 27 forming a tripod arrangement. Of course, other than a tripod arrangement can be Provided without departing from the invention, and the feet may comprise other than struts as shown.

Bearing pads 28 are mounted at the ends of the struts and lie parallel to the boom. And, the transversely extending struts are mounted perpendicular to the boom.

A handgrip assembly 29 is mounted to and extends transversely from the opposite side of the boom at or near the lower end of thereof. The assembly may comprise a lower handle 31 supported by a brace 32, and an upper handgrip 33 mounted on the handle and connected to the boom by a brace 34. Of course, a handgrip assembly other than assembly 29 shown can be provided without departing from the invention.

The length of the struts including the foot pads are set at the predetermined fixed distance y from inner surface 35 of the boom. This distance y is selected for a given width railway car such that distance x from the car centerline to inner surface 35 of the boom does not exceed 5½ feet for a total maximum 11 foot loadwidth of the car.

In use, the operator simply holds the gauge with one hand on handle 31 and the other hand on handgrip 33 and, following the car loading operation, bears foot pads 28 against side sill 17, for example, such that boom 21 is upright as shown in FIG. 1 and lies parallel to side sill 17. The operator thereupon simply walks along the rail bed while sliding the gauge along side sill 17 parallel to the longitudinal axis of the car as the gauge slides with pads 28 bearing against the side sill.

The overhang distance y is verified as the boom either clears the stacked logs or impacts against one or more logs which exceed the permissible overhang distance y. Such log or logs are then simply "bumped up" by the operator by shifting that log inwardly toward the car centerline, or is/are sawed off to maintain the permissible overhang distance y.

The boom is lightweight, easy to manipulate and is readily stored at the job site. And, rollers or roller bearings can be provided at pads 28 or in lieu thereof (not shown) to provide a friction resistant and a snag resistant feature for the gauge device.

Obviously, many other modifications and variations of the Present invention are made possible in the light of the above teachings. For example, the feet of the present gauge can be made extendable and retractable for determining the maximum width of a load supported on railway cars of different widths. It is therefore to be understood that within the scope of the appended claims the invention may be practiced otherwise than as specifically described.

What is claimed is:

1. A gauge for determining the maximum width of a load of materials supported on a railway car having opposing upstanding side sills, the materials extending outwardly beyond said side sills, the gauge comprising a hand-held device having an upstanding elongated boom, foot means connected to said boom and transversely extending from one side of said boom for slidingly bearing against each of said side sills, a terminal end of said foot means being spaced a predetermined fixed distance from said boom for determining the maximum loadwidth by gauging the outward extent of the materials, and means mounted on an opposite side of said boom for manually holding the device and for sliding the device along each of said side sills in a direction along the length of the railway car while said foot means slidingly engage each of said side sills, whereby any extent of the material elements beyond said predetermined fixed distance from each of said side sills is gauged by said boom upon the sliding of the device to thereby determine the maximum width of the load of materials on the car.

2. The gauge according to claim 1, wherein said foot means comprise spaced upper and lower struts having foot pads at said terminal end.

3. The gauge according to claim 1, wherein said holding means comprise spaced upper and lower handle grips for holding the device and for sliding the device along said side sills in said direction with said boom in a substantially upright position.

4. The gauge according to claim 1, wherein said boom comprises a hollow tube of a predetermined fixed length.

* * * * *